US007243654B2

(12) United States Patent
Schuerch

(10) Patent No.: US 7,243,654 B2
(45) Date of Patent: Jul. 17, 2007

(54) ADJUSTABLE POSITION LIMB SUPPORT FOR SURGICAL TABLES

(76) Inventor: Peter Schuerch, 42 Bayview Ave., Quincy, MA (US) 02169

( * ) Notice: Subject to any disclaimer, the term of this patent is extended or adjusted under 35 U.S.C. 154(b) by 0 days.

(21) Appl. No.: 11/398,793

(22) Filed: Apr. 6, 2006

(65) Prior Publication Data

US 2006/0225743 A1 Oct. 12, 2006

Related U.S. Application Data

(60) Provisional application No. 60/669,405, filed on Apr. 8, 2005.

(51) Int. Cl.
*A61G 15/00* (2006.01)
*A47C 17/86* (2006.01)

(52) U.S. Cl. ..... 128/845; 5/648

(58) Field of Classification Search ..... 128/845; 5/648
See application file for complete search history.

(56) References Cited

U.S. PATENT DOCUMENTS 5,918,330 A * 7/1999 Navarro et al. ..... 5/624
6,058,534 A * 5/2000 Navarro et al. ..... 5/648
6,704,959 B2 * 3/2004 Schuerch ..... 5/648

* cited by examiner

*Primary Examiner*—Justine R. Yu
*Assistant Examiner*—K C Matter
(74) *Attorney, Agent, or Firm*—John M Brandt

(57) ABSTRACT

An adjustable position limb support for surgical tables consisting of a limb support arm, a limb cradle attached to the support arm and an orientation control device such as a movable handle located at the distal end of the support arm. The proximate end of the support arm engages a pivot assembly which has one section providing for rotational movement in the lithotomy direction; and a second section providing for rotational movement in the perpendicular abduction direction. Each section has a locking mechanism which is independently secured and released to position the arm as desired. One locking mechanism is operated by the rotation of the support arm and the other by an extendable and retractable linkage activated by the control device.

3 Claims, 4 Drawing Sheets

ADJUSTABLE POSITION LIMB SUPPORT FOR SURGICAL TABLES

CROSS REFERENCE TO RELATED APPLICATIONS

This application is based on the disclosure contained in Provisional Application Ser. No. 60/669,405 filed Apr. 8, 2005 of the same title by the same inventor which is herein incorporated by reference.

BACKGROUND OF THE INVENTION

1. Field of the Invention

The invention resides in the field of limb supports for surgical procedures and more particularly relates to supports adjustable over a selected range of positions.

2. Description of the Prior Art

Adjustable supports for immobilizing limbs during surgical procedures, whether the surgery is performed on the limb or another part of the body near the limb, are known in the prior art. In particular there are positioning devices incorporating ratchet mechanisms which lock into place at preselected positions. Van Steenburg, U.S. Pat. No. 5,802,641, describes a leg holder system utilizing a rotatable handle to simultaneously secure and release a support in both the lithotomy and abduction directions.

Further U.S. Pat. No. 6,058,534, Navarro et al., discloses a support infinitely adjustable over a selected range using a compressed gas locking cylinder which may be secured or locked in a desired position and then unlocked to reposition the support. Finally, an electrically operated limb support is disclosed in U.S. Pat. No. 6,704,959 by the applicant.

In contrast to the prior art, the invention described below provides a hand positionable support utilizing two independent but integrated pivot mechanisms which are secured and released by a single handle incorporating two separate controls.

SUMMARY OF THE INVENTION

The invention may be summarized as a limb, i.e., arm or leg support, arranged to hold and immobilize a limb in a variable selected position during a surgical procedure. The device consists primarily of a limb support arm and a limb support arm pivot assembly attachable to a surgical table. An appropriate limb holding device is attached to the support rod, a surgical boot for example.

The pivot assembly is composed of two separate rotatable sections which provide for the movement of the attached support arm independently in both of the mutually perpendicular lithotomy and abduction directions or dimensions. Each section has an independently operated locking mechanism which secures and releases the pivoting movement in the appropriate dimension. One of such locking mechanisms is controlled by the rotation of the arm itself and the other by a retractable and extendable mechanical linkage such as a cable. The cable is operated by, for example, a control device such as a squeezable or rotatable handle positioned at the distal end of the arm. In this manner, complete positioning control is provided at the same location as that which moves the limb from place to place as required by the surgical procedure.

As two separate independent control motions are required to orient the support arm and limb, i.e., arm rotation and control device activation, the subject limb may be positioned in either dimension while the other dimension is held securely. This method of operation provides substantial security and more precise movement control when orienting a limb that has a natural tendency to shift and drop through weight when released. Further, the divided but integrated pivot mechanism as herein disclosed is less complex, stronger, and more easily repaired than many of the prior art devices known to the applicant.

These and other features and advantages of the invention will become more clear from the description of the preferred embodiment and drawings which follows.

DESCRIPTION OF THE PREFERRED EMBODIMENT

Figure 1:
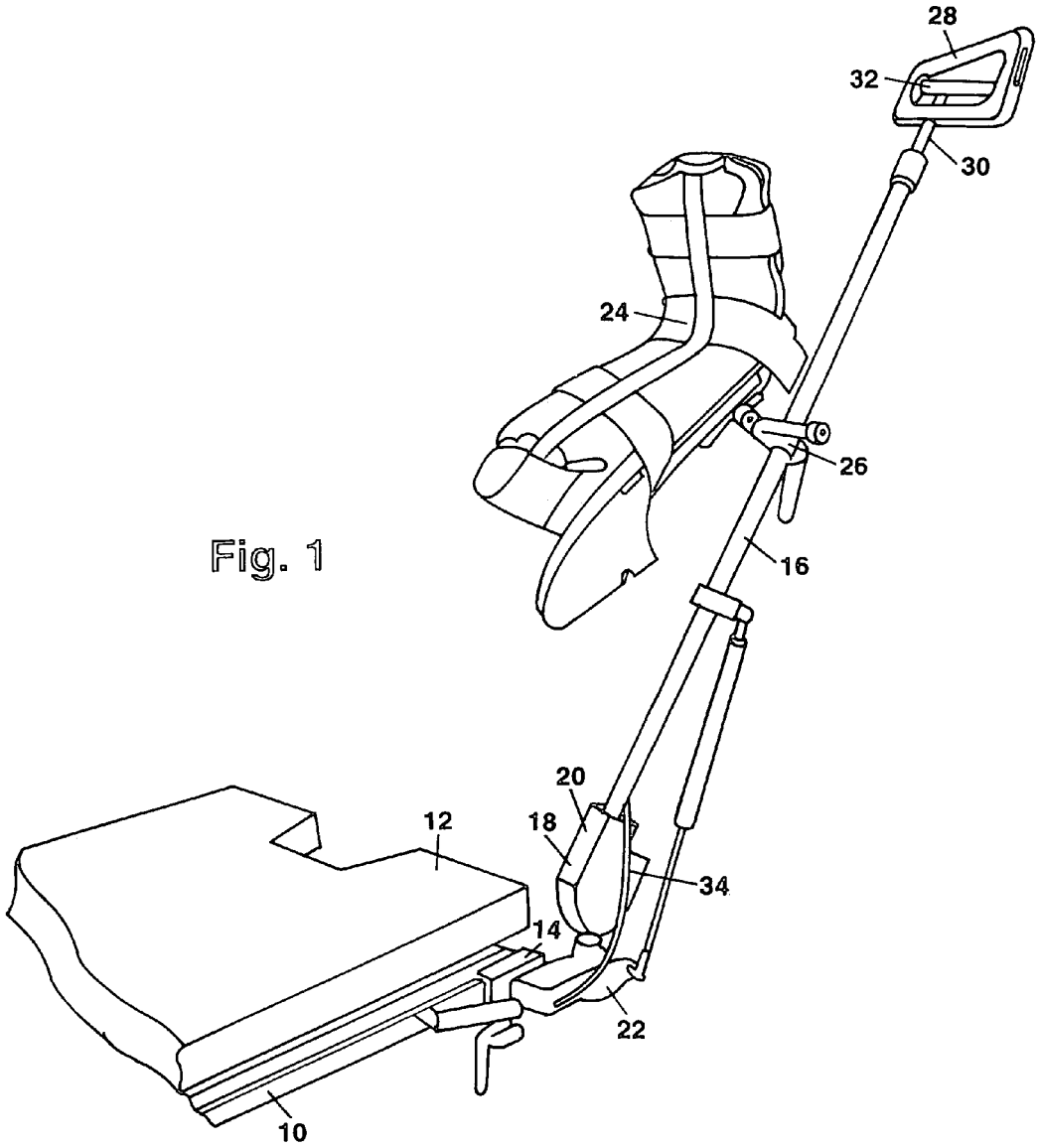
FIG. 1 is a perspective view of the preferred embodiment of the invention.

Referring to FIG. 1, the invention is shown attached to rail 10 of surgical table 12 by clamp 14 and is composed of limb support arm 16 and limb support arm pivot assembly 18. Pivot assembly 18 is further composed of a lithotomy section 20 for up and down positioning and an abduction section 22 for side-to-side motion. A limb support appliance such as a foot and lower leg support 24 is attached to arm 16 by clamp 26, which allows rotational and lateral location adjustment of support 24.

Handle 28 at the end of arm 16 provides for the manipulation of the arm as well as activation and deactivation, i.e., locking of pivot assembly sections 20 and 22. As will be illustrated and described in detail below, handle 28 is rotated to rotate rod 30 disposed within arm 16 to control lithotomy section 20 and further includes a lever 32 arranged to extend and retract a cable within cable assembly 34 to control abduction section 22.

Figure 2:
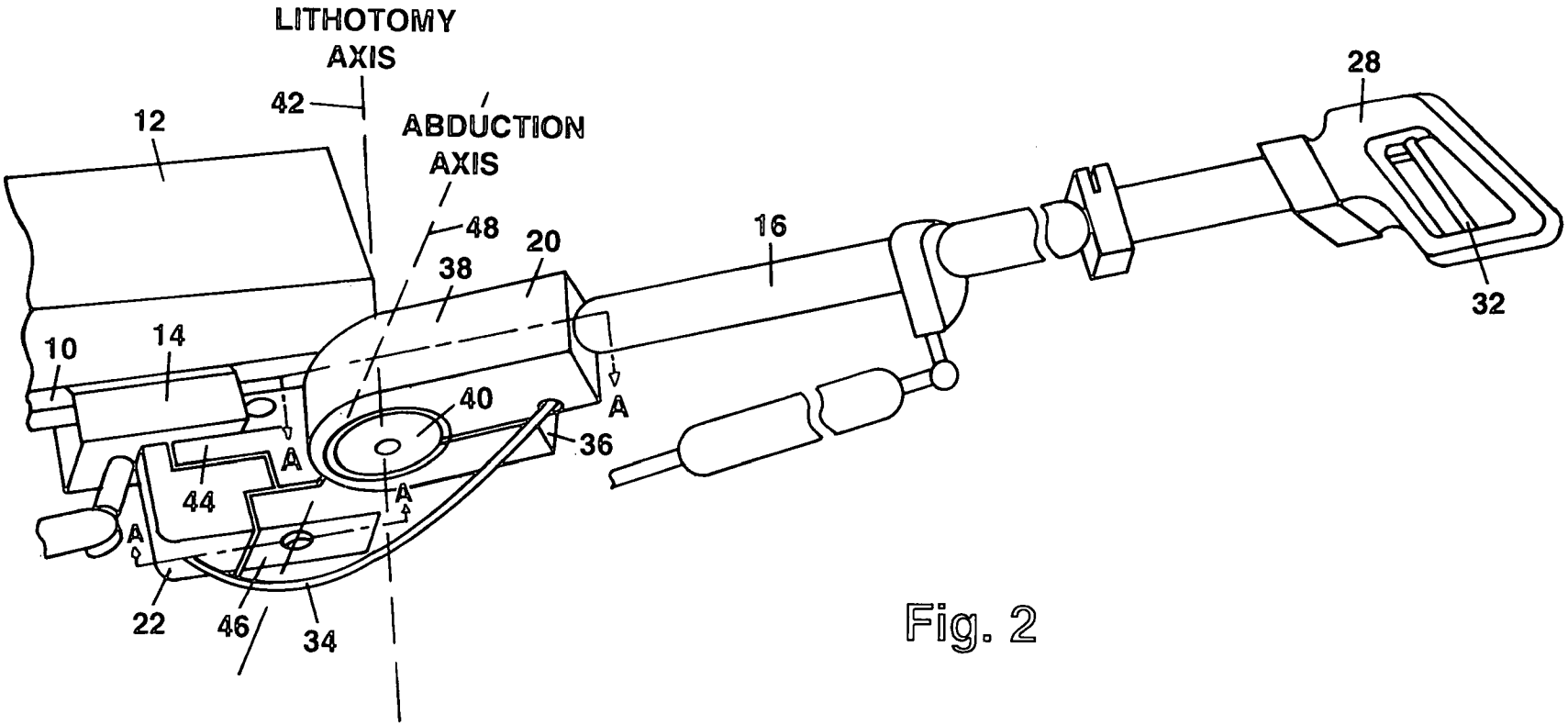
FIG. 2 is another perspective view of the preferred embodiment of the invention.

FIG. 2 is another perspective illustration of the above described device. In addition to the previously identified components, lithotomy section 20 is shown divided into two lithotomy clamping members 36 and 38 surrounding circular bearing 40.The lithotomy clamping members are held together internally under tension locking section 20 and attached support arm 16 about bearing 40. Rotation of handle 28 spreads the lithotomy clamping members sufficiently to free the entire assembly to rotate, that is, move up and down about lithotomy axis 42.

Abduction section 22 is shown divided into two abduction clamping members 44 and 46 gripping a post, not shown but to be described below, extending downward from lithotomy section 20. The abduction clamping members are held together internally under tension locking section 22 and attached section 20 and support arm 16 about the post. The cable within cable assembly 34 is retracted by lever 32 to spread the abduction clamping members sufficiently to free the entire assembly to rotate, that is, move side to side about abduction axis 48.

Figure 3:
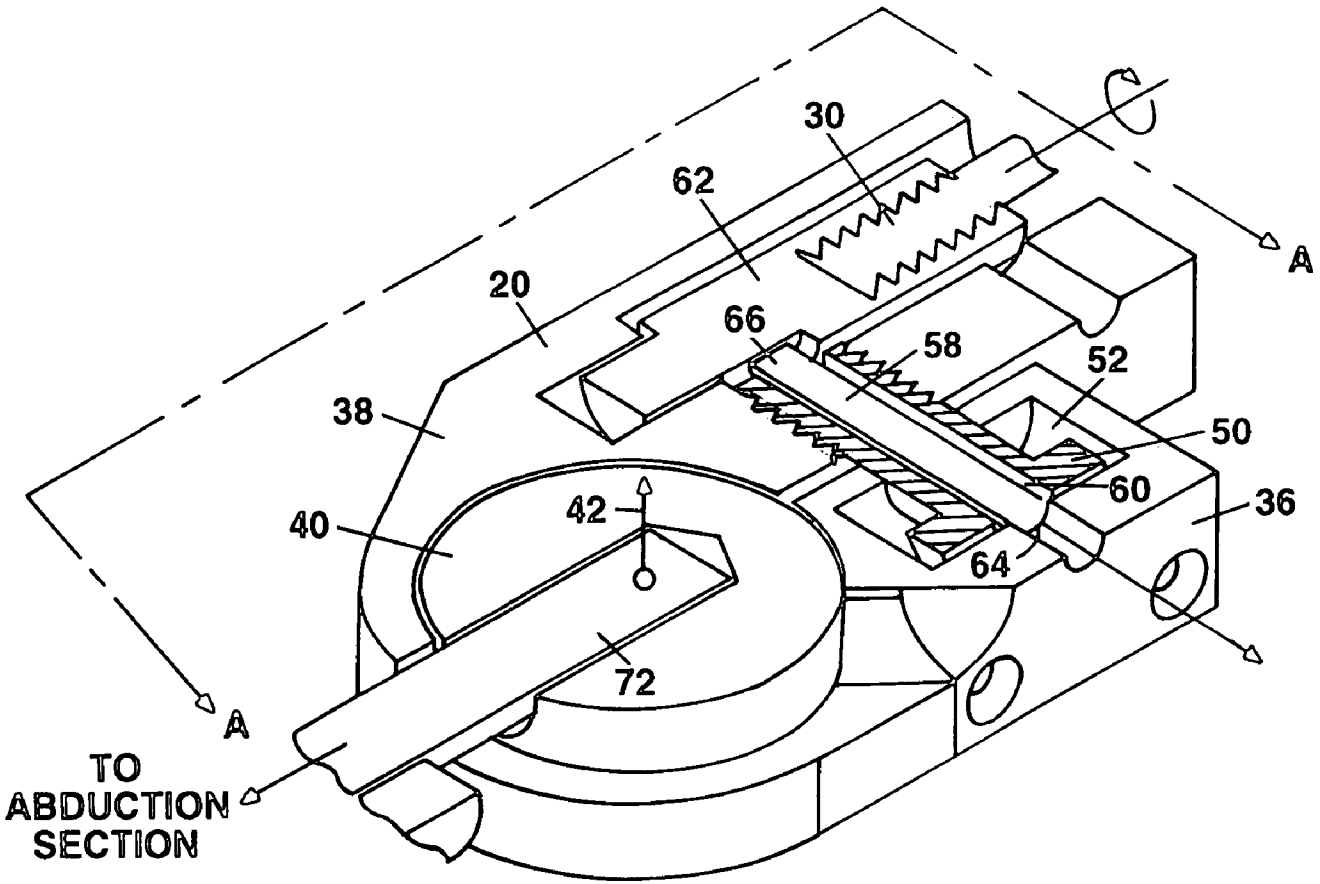
FIG. 3 is a cross-sectional perspective view of one component of the embodiment of FIG. 2 along line A-A.
Figure 5:
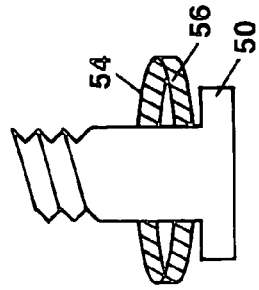
FIG. 5 is a cross-sectional view of a component of the preferred embodiment.

Referring next to FIG. 3, a perspective cross-sectional view along line A-A of FIG. 2 of the lithotomy section 20 is shown consisting of clamping members 36 and 38 held together by bolt 50 under tension from one or more pair of Belleville washers to be disposed in well 52 as is further illustrated in FIG. 5. Washers 54 and 56 are opposed disks of spring metal which compress when forced inward or are drawn together but otherwise provide substantial outward tension in the nature of a spring resulting in members 36 and 38 gripping circular bearing 40.

In order to relax the tension and release or unlock section 20 sufficiently to rotate the section about bearing 40, pin 58 is disposed in central bolt hole 60 and acts to force members 36 and 38 apart upon rotation of cam member 62 by attached rod 30 rotated by handle 28. In operation, pin 58 presses against member 36 at contact surface 64 and cam 62 presses against pin 58 at contact surface 66 resulting in the lithotomy clamp members being spread apart along separation space 68.

Figure 4:
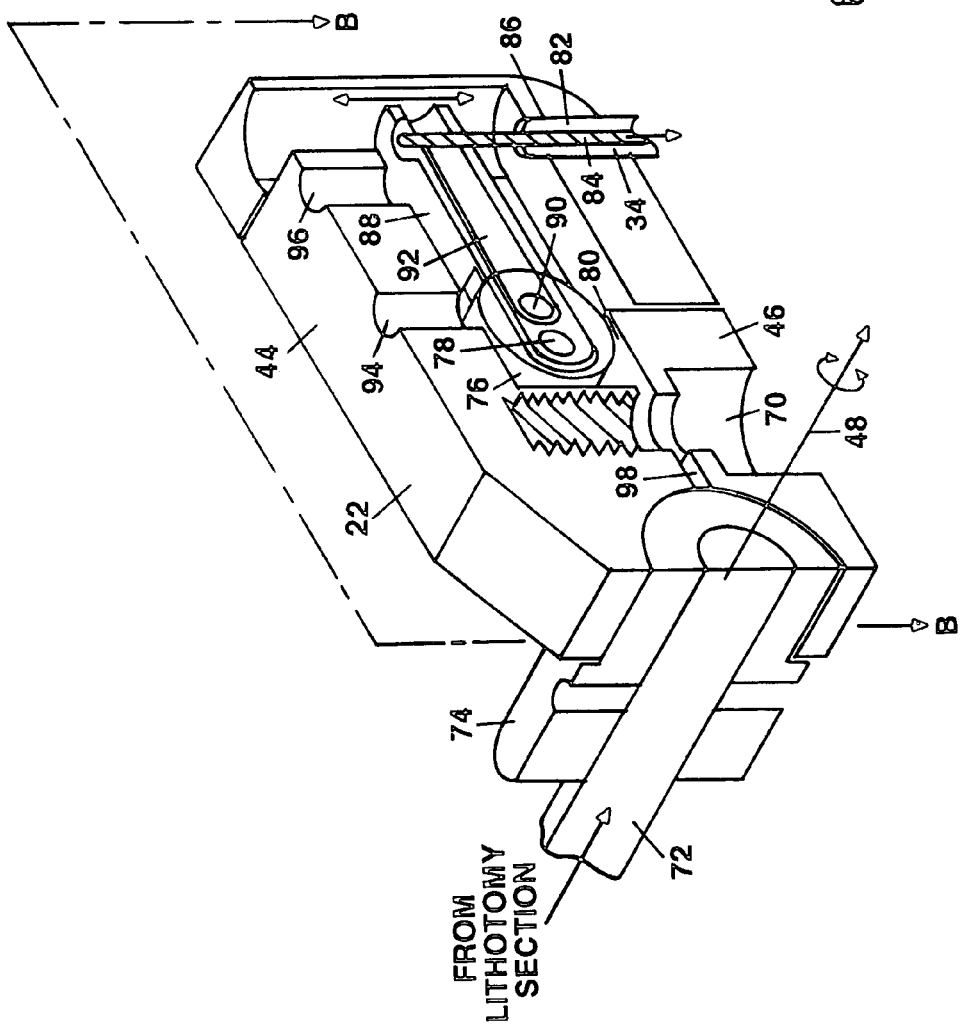
FIG. 4 is a cross-sectional perspective view of an additional component of FIG. 2 along line B-B.

Referring to FIG. 4, a perspective cross-sectional view along line B-B of FIG. 2 of abduction section 22 is shown consisting of abduction clamping members 44 and 46 held together under tension by, for example, the combination of a bolt and one or more pair of Belleville washers to be disposed in well 70 similar to that as described above and as further illustrated in FIG. 5. Post 72 serves to join lithography section 20 and abduction section 22 fitting securely into bearing 74. Bearing 74 is locked in place and prevented from rotating by the clamping action of abduction clamping members 44 and 46 held together by the bolt and washer assembly of FIG. 5.

Cam 76 is rotatably disposed on pivot 78 within clamp member 44 and contacts clamping member 46 on surface 80. The terminus of cable assembly 34 consisting of outer sheath 82 and inner movable cable 84 is also disposed within clamping member 44 through port 86. Extendable and retractable inner cable 84 operated by lever 32 is attached to cam actuator 88 which also rotates on pivot 78. Bar 90 fitted to cam 76 mates with slot 92 in actuator 88.

In operation, inner retractable cable 84 is drawn away from clamping member 44 by squeezing lever 32 at handle end 28 of support bar 16. Cam actuator 88 moves downward guided by slots 94 and 96 in clamping member 44. Cam 76 rotates clockwise about pivot 78 by the force of cam actuator on bar 90. Clamping members 44 and 46 are thereby forced apart at separation plane 98 thus allowing lithotomy section 20 and attached support bar 16 to pivot about abduction axis 48.

Variations in the above described preferred embodiment will now become obvious to those skilled in the art. In particular, the control activation, either rotation or lever operation, in either the lithotomy or abduction directions may be reversed. Further, the locking and unlocking of the pivoting action of the pivoting assembly in either direction may also be reversed, i.e., either clamping device may be locked or unlocked by either of the clamping mechanisms described above or by similar alternative arrangements such as are within the scope of the following claims.

What is claimed is:

1. An adjustable position limb support for a surgical table comprising in combination;

a. a limb support arm having a proximal end and a distal end, said arm further having a longitudinal axis, said arm rotatable about said longitudinal axis;

b. a limb cradle attached to said support arm for receiving said limb;

c. a limb support arm pivot assembly comprising:

1. means for attaching said pivot assembly to said table;

2. a first pivot assembly section pivotable about a first axis;

3. a second pivot assembly section connected to said first section said second section providing means for said first section to pivot about a second axis perpendicular to said first axis;

d. means for attaching said limb support arm to said first pivot assembly section;

e. first locking means communicating with said first section to secure and release the pivotal movement of said first section about said first axis;

f. second locking means communicating with said second section to secure and release the pivotal movement of said first section about said second axis;

g. extendable and retractable linkage means extending from said distal end of said support arm and operatively connected to one of said locking means;

h. control means connected to said linkage means positioned at said distal end of said support arm for extending and retracting said linkage; and i. means responsive to the rotation of said support arm operatively connected to the other of said locking means, whereby the rotation of said support arm about said support arm longitudinal axis operates one of said locking means, and the activation of said control means operates the other of said locking means.

2. The limb support of claim 1 wherein said first axis comprises a lithotomy axis and said second axis comprises an abduction axis.

3. The limb support of claim 2 wherein at least one of said locking means comprises in combination:

a. a circular bearing;

b. a pair of clamping members in fixed position to one another arranged to engage said bearing, said clamping members biased in contact with said bearing so as to lock said members in a selected position in relation to said bearing; and c. means to release said bias to provide separation of said clamping members sufficient to allow said members to pivot about said bearing.

* * * * *